US008366879B2

(12) United States Patent
Crane et al.

(10) Patent No.: US 8,366,879 B2
(45) Date of Patent: Feb. 5, 2013

(54) SOIL AND/OR MOISTURE RESISTANT SECURE DOCUMENT

(75) Inventors: Timothy T. Crane, Windsor, MA (US); Michael Darroch, Dalton, MA (US); Tod L. Niedeck, Lenox, MA (US); Marco Maraschi, Molndal (SE); Karin Morck-Hamilton, Stockholm (SE)

(73) Assignee: Crane & Co., Inc., Dalton, MA (US)

( * ) Notice: Subject to any disclaimer, the term of this patent is extended or adjusted under 35 U.S.C. 154(b) by 564 days.

(21) Appl. No.: 12/312,103

(22) PCT Filed: Sep. 24, 2007

(86) PCT No.: PCT/US2007/020571

§ 371 (c)(1),
(2), (4) Date: Apr. 2, 2010

(87) PCT Pub. No.: WO2008/054581

PCT Pub. Date: May 8, 2008

(65) Prior Publication Data

US 2010/0230947 A1 Sep. 16, 2010

Related U.S. Application Data

(60) Provisional application No. 60/863,246, filed on Oct. 27, 2006.

(51) Int. Cl.
*D21H 21/16* (2006.01)
*D21H 21/40* (2006.01)
*D21H 21/42* (2006.01)

(52) U.S. Cl. ..... 162/140; 162/135; 162/158; 162/168.2; 283/72; 283/92

(58) Field of Classification Search ..... 162/103, 162/134–137, 140, 158, 164.1, 164.6, 168.1, 162/168.2; 428/195.1; 283/72, 82–83, 107–111, 283/113, 92; 427/358, 361, 391
See application file for complete search history.

(56) References Cited

U.S. PATENT DOCUMENTS

| | | | | |
|---|---|---|---|---|
| 4,437,935 | A * | 3/1984 | Crane, Jr. | 162/103 |
| 4,462,866 | A * | 7/1984 | Tooth et al. | 162/103 |
| 4,617,341 | A | 10/1986 | Laine et al. | |
| 4,644,030 | A | 2/1987 | Loewrigkeit et al. | |
| 5,486,022 | A * | 1/1996 | Crane | 283/83 |
| 5,660,919 | A | 8/1997 | Vallee et al. | |
| 5,868,902 | A | 2/1999 | Howland et al. | |
| 5,928,471 | A | 7/1999 | Howland et al. | |
| 6,176,522 | B1 | 1/2001 | Jackson | |
| 6,566,470 | B2 * | 5/2003 | Kantamneni et al. | 526/245 |
| 6,616,803 | B1 * | 9/2003 | Isherwood et al. | 162/103 |
| 6,930,606 | B2 * | 8/2005 | Crane et al. | 340/572.1 |
| 7,243,951 | B2 * | 7/2007 | Cote et al. | 283/72 |
| 7,333,268 | B2 | 2/2008 | Steenblik et al. | |
| 7,431,798 | B2 * | 10/2008 | Watson | 162/140 |
| 7,468,842 | B2 * | 12/2008 | Steenblik et al. | 359/619 |
| 7,632,380 | B2 * | 12/2009 | Doublet | 162/140 |
| 2002/0014967 | A1 * | 2/2002 | Crane et al. | 340/572.8 |
| 2003/0173046 | A1 * | 9/2003 | Jaaskelainen et al. | 162/140 |
| 2004/0023008 | A1 | 2/2004 | Rosset | |
| 2008/0036195 | A1 * | 2/2008 | Winchcombe | 283/85 |
| 2009/0302595 | A1 * | 12/2009 | Rubio Sanz et al. | 283/82 |
| 2010/0207377 | A1 * | 8/2010 | Camus et al. | 283/72 |
| 2010/0208313 | A1 * | 8/2010 | Horgan et al. | 359/2 |
| 2010/0230947 | A1 * | 9/2010 | Crane et al. | 283/108 |
| 2010/0276919 | A1 * | 11/2010 | Dietemann | 283/74 |
| 2011/0229696 | A1 * | 9/2011 | Ratnukumar et al. | 428/172 |

FOREIGN PATENT DOCUMENTS

| | | | |
|---|---|---|---|
| EP | 279880 | A1 * | 8/1988 |
| EP | 1273704 | | 1/2003 |
| WO | WO 98/14661 | | 4/1998 |
| WO | WO 00/00697 | | 1/2000 |
| WO | WO 2005100040 | A1 * | 10/2005 |
| WO | WO 2008054581 | A1 * | 5/2008 |
| WO | WO 2009150117 | A1 * | 12/2009 |

OTHER PUBLICATIONS

Joyce et al., "Mechanical Consequences of Coating Penetration," Jun. 1997, Journal of Coatings technology, vol. 69, No. 869, pp. 53-58.*

* cited by examiner

*Primary Examiner* — Jose A Fortuna
(74) *Attorney, Agent, or Firm* — Holland & Bonzagni, P.C.; Mary R. Bonzagni, Esq.

(57) ABSTRACT

A soil and/or moisture resistant secure document and a method for producing such a secure document, are provided. The inventive method preferably employs a size press or other similar device to force a soil and/or moisture resistant formulation into the pores of the substrate and to remove excess formulation from opposing surfaces thereof. Soil and/or moisture resistant formulations when applied this way instead of by way of standard coating techniques do not obscure optically variable effects generated by non-porous OVDs that may be employed on or within these secure documents. In addition, thin layers of fibers (e.g., papermaking fibers) overlying and thus embedding portions of security devices in windowed secure documents that have been rendered soil and/or moisture resistant in accordance with this invention demonstrate increased durability.

15 Claims, No Drawings

SOIL AND/OR MOISTURE RESISTANT SECURE DOCUMENT

RELATED APPLICATION

This application claims the benefit of U.S. Provisional Patent Application Ser. No. 60/863,246, filed Oct. 27, 2006, which is fully incorporated herein by reference.

TECHNICAL FIELD

The present invention generally relates to a soil and/or moisture resistant secure document and to a method for producing such a secure document.

BACKGROUND AND SUMMARY OF THE INVENTION

Optically variable security devices such as thin films, holograms, gratings, micro-prisms, photochromics, and more recently, microlens-based film structures (hereinafter collectively referred to as OVDs), are recognized as valued additions to secure documents such as banknotes. These devices allow for a variety of self-authenticating optical effects while rendering the secure document more resistant to counterfeiting.

Microlens-based OVDs are described in U.S. Patent Application Publication No. 2005/0180020 A1 to Steenblik et al. The film material or structure described in this reference employs a regular two-dimensional array of non-cylindrical lenses to enlarge micro-images and, in one embodiment, comprises (a) an optical spacer; (b) a regular periodic planar array of image icons positioned on one surface of the optical spacer; and (c) a regular periodic array of lenses positioned on an opposing surface of the optical spacer. The images projected by this film structure show a number of visual effects including orthoparallactic movement.

OVDs in the form of security patches, are mounted on one or both surfaces of a security document (e.g., banknote), while OVDs in the form of security strips or threads, are partially embedded within the document, with the OVDs being visible in one or more clearly defined windows on one or both surfaces of the document.

One of the primary requirements of banknotes and other secure documents is that the document must resist the effects of circulation. These documents must be durable (i.e., resistant to fold damage, tearing and soiling) and resistant to moisture and chemical absorption. In addition, the print which is applied to the document must adhere well, especially under severe conditions such as mechanical abrasion and accidental laundering.

In order to render banknotes and other secure documents more resistant to the effects of circulation; manufacturers and printers have coated the documents with certain varnishes and polymeric coatings. These varnishes and coatings, which consist of either ultraviolet (UV) radiation-crosslinkable prepolymers (100% solids), or resin mixtures with different host solvents (resin solids content ranging from 30 to 50% by weight), serve to seal the surface of the document increasing its resistance to soiling and moisture. Typically applied in a final, or near final step in the document's production using standard coating techniques (e.g., roller coating, gravure coating, air knife coating, roll coating, blade coating), these surface coatings are generally referred to as post-print varnishes. Coat weights applied to each side of the document surface range from 0.5 grams per square meter ($g/m^2$) to 5.0 $g/m^2$.

A more recent trend has been to apply a coating to substrates used in the production of these secure documents either during or immediately following manufacture. These surface coatings, commonly referred to as pre-print coatings, may be described as aqueous resin binder systems that serve to render the document resistant to moisture and soiling. Pre-print coatings may constitute or make up 1 to 15% of the document's finished mass.

Unfortunately, OVDs in secure documents subjected to one or both of these prior art techniques are at least partially obscured or otherwise adversely affected as a result of the overlying varnish or coating. As will be readily appreciated by those skilled in the art, OVDs rely on unique surface topographies in order to produce novel and specifically engineered visual and machine verifiable effects. Covering these surfaces with coatings and varnishes can cloud, mute, distort or otherwise diminish the features' effect.

As the requirement for resistance to soiling and moisture increases, generally the amount of pre-print coatings and/or post-print varnishes applied to the substrate is likewise increased. A trade-off then occurs in the form of increased substrate durability in exchange for reduced performance and effectiveness of some security features. In addition, some types of varnishes contain light scattering or light diffusing additives to reduce an appearance of glossiness on the finished, varnished documents. These additives can further decrease the effects of some security features.

In an effort to avoid these detrimental effects on the optically variable effects generated by OVDs, certain manufacturers (i) use very light coat weights of pre-print coatings or post-print varnishes, which reduces the document's ability to resist moisture and soiling, (ii) avoid the combination of pre-print coatings or post-print varnishes with certain OVD security features, or (iii) block the areas on the document surface prior to applying the pre-print coating or post-print varnish, which leaves significant areas of the document surface unprotected and unduly complicates the application process.

It has been discovered by the present inventors that the optical effect of these OVDs can be preserved without compromising soil and/or moisture resistance by applying a soil and/or moisture resistant formulation by way of a size press or other similar device instead of by way of standard coating techniques. It has also been discovered that thin layers of fibers (e.g., papermaking fibers) overlying and thus embedding portions of security devices in windowed secure documents rendered soil and/or moisture resistant in this way demonstrate increased durability.

The present invention therefore generally provides a method for imparting soil and/or moisture resistance to a porous substrate used in the manufacture of secure to documents, the porous substrate having a thickness. The inventive method comprises (a) applying a soil and/or moisture resistant formulation to opposing surfaces of the porous substrate, (b) forcing the soil and/or moisture resistant formulation into the pores of the substrate, the formulation thereby penetrating and extending throughout at least a portion of the thickness of the substrate, and (c) removing excess formulation from opposing surfaces of the substrate. Preferably, a size press (e.g., puddle or metering) or other similar device is used to force the soil and/or moisture resistant formulation into the pores of the substrate and to remove excess formulation from opposing surfaces thereof.

In a first contemplated embodiment, the inventive method imparts soil and/or moisture resistance to the porous substrate without obscuring optically variable effects generated by non-porous OVDs contained (or exposed) on a surface thereof, the method comprising:

(a) applying a soil and/or moisture resistant formulation to opposing surfaces of the porous substrate, the substrate supporting one or more non-porous OVDs; and (b) employing a size press or other similar device to force the soil and/or moisture resistant formulation into the pores of the substrate and to remove excess formulation from opposing surfaces thereof, thereby leaving exposed surfaces of the non-porous OVDs substantially free of the soil and/or moisture resistant formulation.

The term "non-porous OVDs", as used herein, includes those OVDs having substantially or essentially non-porous surfaces, and those OVDs having surfaces that are substantially or essentially non-porous only in areas contained (or exposed) on a surface of the porous substrate.

In a second contemplated embodiment, the inventive method imparts soil and/or moisture resistance to a windowed porous substrate supporting one or more security devices while increasing the durability of the substrate in areas overlying the security device(s), those areas of the substrate framing the device(s) and forming at least one window through which the security device(s) is exposed, the method comprising:

(a) applying a soil and/or moisture resistant formulation to opposing surfaces of the porous substrate having the one or more security devices partially embedded therein and visible in one or more windows on at least one surface thereof; and (b) employing a size press or other similar device to force the soil and/or moisture resistant formulation into the pores of the porous substrate and to remove excess formulation from opposing surfaces thereof.

The present invention also generally provides a soil and/or moisture resistant secure document, which comprises at least one porous substrate having a thickness, and an effective amount of a soil and/or moisture resistant formulation contained within the pores and on opposing surfaces of the porous substrate(s), wherein the soil and/or moisture resistant formulation is distributed throughout at least a portion of the thickness of the porous substrate(s).

In a first contemplated embodiment, the inventive soil and/or moisture resistant secure document further comprises one or more non-porous OVDs contained on and/or partially within the substrate(s), wherein the one or more non-porous OVDs have exposed surfaces that are substantially free of the soil and/or moisture resistant formulation. The phrase "substantially free", as used herein, means that the non-porous OVDs have only residual or trace amounts of formulation on exposed surfaces thereof.

In a second contemplated embodiment, the inventive soil and/or moisture resistant secure document is a windowed secure document having one or more security devices partially embedded therein and exposed in one or more windows, those areas of the secure document overlying the one or more security devices demonstrating increased durability. Preferably, the one or more security devices are non-porous, optically variable, security strips or threads having surfaces that are substantially free of the soil and/or moisture resistant formulation.

Other features and advantages of the invention will be apparent to one of ordinary skill from the following detailed description. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BEST MODE FOR CARRYING OUT THE INVENTION

By way of the present invention, it has been discovered that soil and/or moisture resistant materials when applied by way of a size press or other similar device instead of by way of standard coating techniques do not obscure the optically variable effects generated by OVDs employed on or within banknotes and other secure documents. It has also been discovered that the durability of thin fibrous layers overlying a security strip or thread embedded in a windowed banknote or other secure document is increased when soil and/or moisture resistant materials are applied during manufacture by way of a size press or other similar device.

Practice of the present invention allows for improved process economics where the inventive method represents a more time-efficient, streamlined pathway to providing soil and/or moisture resistance to secure documents by obviating the need for pre-print coating and post-print varnishing processes and the concomitant capital investment in the necessary coating and varnishing equipment.

Although the soil and/or moisture resistant secure document of the present invention will be described herein mainly for use in the manufacture of banknotes, the invention is not so limited. The inventive secure document can be used to prepare a variety of different items including checks, identity cards, lottery tickets, passports, postage stamps, stock certificates, and the like.

As noted above, the soil and/or moisture resistant secure document of the present invention comprises at least one porous substrate having a thickness, and an effective amount of a soil and/or moisture resistant formulation contained within the pores and on opposing surfaces of the substrate(s), wherein the soil and/or moisture resistant formulation is distributed throughout at least a portion of the thickness of the porous substrate(s).

Substrates suitable for use in the present invention are paper or paper-like sheet materials having a porosity of from about 2 to about 100 milliliters per minute (ml/min), preferably from about 5 to about 50 ml/min. Porosity is defined as the air permeability as determined according to ISO standard 5636-3 (Sep. 15, 1992). This test can be performed with an L&W Bendtsen Tester of AB Lorentzen & Wettre, Kista, Sweden.

These sheet materials, which are single or multi-ply sheet materials, may be made from a variety of fibers such as abaca, cotton, linen, wood pulp, and blends thereof. As is well known to those skilled in the art, cotton and cotton/linen blends are preferred for banknotes, while wood pulp is commonly used in non-banknote security documents.

The soil and/or moisture resistant formulation contemplated for use in the present invention is preferably prepared as an aqueous formulation (e.g., dispersion) containing components, at least some of which are found in prior art pre-print coatings and post-print varnishes. Included among these components are thermoplastic resins such as resins having an ester bond (e.g., polyester resins, polyether resins), polyurethane resins, functionalized polyurethane resins (e.g., carboxylated polyurethane resins), and copolymers (e.g., urethane-acrylic resins, polyether-urethane resins, styrene acrylate resins) and mixtures thereof.

In addition to the above components, the soil and/or moisture resistant formulation of the present invention may advantageously contain other solvents, cosolvents or diluents as well as additives including (but not limited to) antimicrobial agents, catalysts, crosslinking agents (e.g., silane crosslinking agents), defoaming agents, pigments (e.g., titanium dioxide), plasticizers, stabilizers, surfactants or wetting agents, and viscosity modifiers, provided any such solvent, cosolvent, diluent, or additive does not adversely impact upon the desirable properties of the resulting secure document.

In a preferred embodiment, the soil and/or moisture resistant formulation is an aqueous polymer dispersion, the average particle size of the dispersed particles found in the polymer dispersion ranging from about 50 to about 150 nanometers (nm) (preferably, from about 70 to about 140 nm).

In a more preferred embodiment, the soil and/or moisture resistant aqueous polymer dispersion contains particles or solids of polyurethane resins, polyether-urethane resins, and/or urethane-acrylic resins (resin solids content of dispersion ranging from 30 to 50% by dry weight, preferably from about 35 to about 45% by dry weight). In yet a more preferred embodiment, the soil and/or moisture resistant aqueous polymer dispersion further contains one or more pigments such as titanium dioxide pigment, and optionally one or more crosslinking agents. An example of one such polyurethane dispersion (without a pigment and crosslinking agent(s)) is available from Roymal, Inc., Newport, N.H., U.S.A., under the trade designation NOTEGUARD PRIMER polyurethane dispersion.

The soil and/or moisture resistant formulation is made by mixing the component(s) with water so as to obtain an aqueous formulation having a total solids content ranging from about 10 to about 40% by dry weight (preferably, from about 15 to about 30% by dry weight, and more preferably from about 20 to about 25% by dry weight), based on the total dry weight of the formulation. The pH of the aqueous formulation is between 5.5 and 9.5, and preferably is between 6.0 and 8.0.

Preferably, pigment is added to the formulation just prior to applying it to the porous substrate. Pigment is used to counteract the transparentizing effect of resin pickup and incorporation into the porous substrate or base sheet. Adding pigment to the formulation just prior to its application to the base sheet obviates the need for stabilizers to assure homogeneity. It also allows for these formulations to be customized for different paper grades with different requirements, and even allows for batch-to-batch adjustments during production of a particular grade.

The inventive method for imparting soil and/or moisture resistance to a porous substrate comprises (a) applying the above-described soil and/or moisture resistant formulation to opposing surfaces of the porous substrate, (b) forcing the soil and/or moisture resistant formulation into the pores of the substrate, the formulation thereby penetrating and extending throughout at least a portion of the thickness of the substrate, and (c) removing excess formulation from opposing surfaces of the substrate. Preferably, a size press or other similar device is used to force the soil and/or moisture resistant formulation into the pores of the substrate and to remove excess formulation from opposing surfaces thereof.

As is well known to those skilled in the art, upon leaving the "wet-end" of a papermaking machine, a fibrous web containing a considerable amount of water is directed toward a press section (e.g., a series of heavy rotating cylinders), which serves to press the water from the web, further compacting it and reducing its water content, typically to about 70% by weight.

Following pressing, the paper web is dried in the main dryer section of the papermaking machine. In the drying section, which is typically the longest section of the papermaking machine, hot air or steam-heated cylinders contact both sides of the web, substantially drying the web by evaporating the water to a level of approximately 5% by weight of the paper.

The dried web or substrate is then surface sized at a size press. By way of the present invention, the size press is used to force an effective amount (i.e., from about 5 to about 20% by dry weight, preferably from about 7.5 to about 12.5% by dry weight, based on the total dry weight of the size press-treated substrate) of the soil and/or moisture resistant formulation into the interstices of the substrate from both sides of the substrate. The size press is also used to remove excess formulation from opposing surfaces of the substrate. Penetration and distribution of the formulation is thus achieved throughout at least a portion of the thickness of the substrate.

The size press-treated substrate is then dried in a secondary dryer section of the papermaking machine to a moisture level of from about 4 to about 6%.

The Gurley porosity of the resulting secure document preferably ranges from about 15,000 to about 300,000 seconds, and more preferably ranges from about 40,000 to about 150,000 seconds. Gurley porosity values are determined using TAPPI Test Method No. T-460 om-06 (2006).

The soil and/or moisture resistant formulation provides the resulting secure document with superior durability. Moreover, the printability of the secure document is not adversely affected and in fact may be improved.

For secure documents employing one or more non-porous OVDs, the soil and/or moisture resistant formulation provides the resulting secure document with superior durability without diminishing the optically variable effects generated by the OVDs. More specifically, in those areas of the substrate in which a non-porous OVD is present, the OVD causes the formulation to be rejected from the surface of the OVD as the hydraulic pressure of the size press increases. The surface of the OVD is left substantially free of the formulation that now resides within the pores and on opposing surfaces of the substrate.

For windowed secure documents, those portions of the secure document overlying partially embedded security devices demonstrate increased durability in the form of a reduced tendency to tear and crack.

As is well known to those skilled in the art, a security strip or thread that is partially embedded within and partially exposed on the surface of a banknote or other secure document is commonly referred to as a windowed thread. The embedded areas of the thread are covered with a thin layer of paper that serves to frame the thread and form at least one window through which the thread is exposed. This thin layer of paper can be the result of any technique employed in the paper-making industry. By way of example, the thread may be fed into a cylinder mold papermaking machine, cylinder vat machine, fourdrinier papermaking machine, or similar machine of known type, upon which a suspension of papermaking fibers or papermaking stock is deposited (or selectively deposited) onto the security thread; or is formed around it; or is displaced from an already formed web. By way of further example, laminating or wet laminating techniques, as well as techniques involving spraying of fibrous suspensions over select areas of the thread, can be employed to achieve partial embedment. The overlying borders and bridges that result not only cover a portion of the security thread, but are an integrated rather than separately attached part of the paper structure.

One method of simulating the degradation effects that a secure document or banknote endures in circulation is described in the publication: Bartz, W. J., and Crane, T. T, "The Circulation Simulator Method for Evaluating Bank Note and Optical Feature Durability", SPIE Vol. 6075, San Jose, Calif., January 2006. This publication describes a test method developed by Crane & Co., Inc. that simulates the deterioration observed in actual circulated banknotes—i.e. soiling, creasing, tearing, edge tatteredness and limpness. The test method described, which is hereinafter referred to as "the Circulation Simulator Method", utilizes a tumbler mounted on a lathe. Banknote specimens are weighted on each corner and are tumbled in a medium of glass beads, metal discs and a synthetic soil mixture for three, 30-minute cycles, during which physical degradation of the note specimens occurs. Durability is judged by how well a note retains its initial optical and physical properties after being subjected to the conditions of the Circulation Simulator Method.

Banknotes containing security threads that have been subjected to the described conditions of the Circulation Simulator Method can in some circumstances display weakness in the thin paper layer that covers the security thread. This weakness is exemplified by cracking or tearing of this paper layer. One observation that has been made about windowed banknotes containing non-porous, microlens-based, optically variable security threads that have been produced in accordance with the present invention is that the thin paper layer that covers the security thread better resists the degradation effects imposed by way of the Circulation Simulator Method. This improved strength or increased durability is visually apparent, exemplified by the thin paper layer remaining intact and free from tearing and cracking.

While various embodiments of the present invention have been described above, it should be understood that they have been presented by way of example only, and not limitation. Thus, the breadth and scope of the present invention should not be limited by any of the exemplary embodiments.

Having thus described the invention, what is claimed is:

1. A soil and/or moisture resistant secure document, which comprises at least one porous substrate having a thickness, an effective amount of a soil and/or moisture resistant formulation contained within the pores and on opposing surfaces of the porous substrate(s), wherein the soil and/or moisture resistant formulation is distributed throughout the thickness of the porous substrate(s), and one or more non-porous, optically variable security devices contained on and/or partially within the substrate(s), wherein the one or more non-porous, optically variable security devices have exposed surfaces that are substantially free of the soil and/or moisture resistant formulation.

2. The soil and/or moisture resistant secure document of claim 1, wherein the secure document is a windowed secure document having the one or more security devices partially embedded therein and exposed in one or more windows, wherein areas of the secure document overlying the one or more security devices demonstrate increased durability in the form of reduced cracking or tearing as compared to a secure document that does not contain the soil and/or moisture resistant formulation.

3. The secure document of claim 2, wherein the one or more security devices are one or more non-porous, optically variable security strips or threads having surfaces that are substantially free of the soil and/or moisture resistant formulation.

4. The soil and/or moisture resistant secure document of claim 1, which has a porosity ranging from about 15,000 to about 300,000 seconds, determined in accordance with TAPPI Test Method No. T-460 om-06 (2006).

5. The soil and/or moisture resistant secure document of claim 4, which has a porosity ranging from about 40,000 to about 150,000 seconds.

6. The soil and/or moisture resistant secure document of claim 1, wherein the one or more non-porous, optically variable security devices is selected from the group of thin films, holograms, gratings, micro-prisms, photochromics, and microlens-based film structures.

7. The soil and/or moisture resistant secure document of claim 6, wherein the one or more non-porous, optically variable security devices is a microlens-based film structure in the form of a security strip or thread that is partially embedded within the document, with the film structure being visible in one or more clearly defined windows on one or both surfaces of the document.

8. The soil and/or moisture resistant secure document of claim 1, wherein the soil and/or moisture resistant formulation is an aqueous formulation containing thermoplastic resins selected from the group of resins having an ester bond, polyurethane resins, functionalized polyurethane resins, and copolymers and mixtures thereof.

9. The soil and/or moisture resistant secure document of claim 8, wherein the soil and/or moisture resistant formulation is an aqueous polymer dispersion comprising dispersed particles having average particle sizes ranging from about 50 to about 150 nanometers.

10. The soil and/or moisture resistant secure document of claim 9, wherein the aqueous polymer dispersion comprises from about 10 to about 40% by dry weight of resin particles or solids selected from the group of polyurethane resins, polyether-urethane resins, urethane-acrylic resins, and mixtures thereof.

11. The soil and/or moisture resistant secure document of claim 10, wherein the aqueous polymer dispersion further comprises one or more pigments, and optionally one or more crosslinking agents.

12. A soil and/or moisture resistant secure document, which comprises at least one porous substrate having a thickness, an effective amount of a soil and/or moisture resistant formulation contained within the pores and on opposing surfaces of the porous substrate(s), and one or more non-porous, optically variable security devices having a microstructured surface contained on and/or partially within the substrate(s), wherein the one or more non-porous devices have exposed surfaces that are substantially free of the soil and/or moisture resistant formulation.

13. The soil and/or moisture resistant secure document of claim 12, wherein the one or more non-porous, optically variable security devices is selected from the group of thin films, holograms, gratings, micro-prisms, photochromics, and microlens-based film structures.

14. The soil and/or moisture resistant secure document of claim 13, wherein the one or more non-porous, optically variable security devices is a microlens-based film structure.

15. A windowed soil and/or moisture resistant secure document, which comprises at least one porous substrate having a thickness, one or more security devices partially embedded therein and exposed in one or more windows, and an effective amount of a soil and/or moisture resistant formulation contained on opposing surfaces and distributed throughout the thickness of the porous substrate(s), wherein areas of the porous substrate overlying the one or more security devices demonstrate increased durability in the form of reduced cracking or tearing as compared to a secure document that does not contain the soil and/or moisture resistant formulation.

* * * * *